US005256511A

United States Patent [19]

Matsumura et al.

[11] Patent Number: 5,256,511

[45] Date of Patent: Oct. 26, 1993

[54] CARRIER FOR DEVELOPING ELECTROSTATIC LATENT IMAGE AND PROCESS FOR PRODUCING THE SAME

[75] Inventors: Yasuo Matsumura; Hiroshi Takano; Masahiro Takagi; Mamoru Yoshimura, all of Minami-ashigara, Japan

[73] Assignee: Fuji Xerox Co., Ltd., Tokyo, Japan

[21] Appl. No.: 836,385

[22] Filed: Feb. 18, 1992

[30] Foreign Application Priority Data

Feb. 20, 1991 [JP] Japan ..... 3-26276
Feb. 20, 1991 [JP] Japan ..... 3-26277
Feb. 25, 1991 [JP] Japan ..... 3-29816

[51] Int. Cl.[5] ..... G03G 9/113
[52] U.S. Cl. ..... 430/108; 428/407
[58] Field of Search ..... 430/108; 428/407

[56] References Cited

U.S. PATENT DOCUMENTS 3,873,355 3/1975 Queener et al. ..... 430/108
4,297,427 10/1981 Williams et al. ..... 430/108
4,937,166 6/1990 Creatura et al. ..... 430/108
5,075,158 12/1991 Kouno et al. ..... 430/108 X

FOREIGN PATENT DOCUMENTS 49-51950 5/1974 Japan .
54-35735 3/1979 Japan .
54-110839 8/1979 Japan .
55-118047 9/1980 Japan .
56-113146 9/1981 Japan .
60-170865 9/1985 Japan .
62-106475 5/1987 Japan .
63-235963 9/1988 Japan .
63-235964 9/1988 Japan .
63-298254 12/1988 Japan .

*Primary Examiner*—Roland Martin
*Attorney, Agent, or Firm*—Oliff & Berridge

[57] ABSTRACT

A carrier for developing an electrostatic latent image, which carrier comprises core particles having formed thereon a resin coating layer, in which the resin coating layer comprises a fluorine-containing resin and a second resin having a softening point lower than that of the fluorine-containing resin, and the resin and the second resin each are partially exposed on the surface of said resin coating layer. The carrier may be produced by a process comprising the steps of: dry-blending core particles, a fluorine-containing resin, and a second resin having a softening point lower than that of said fluorine-containing resin; and melting the resin blend to coat said core particles. The carrier is excellent in stability with time and environmental changes, causes no adhesion, and is less consumed.

6 Claims, No Drawings

CARRIER FOR DEVELOPING ELECTROSTATIC LATENT IMAGE AND PROCESS FOR PRODUCING THE SAME

FIELD OF THE INVENTION

The present invention relates to a carrier of a two-component developer for developing an electrostatic latent image formed by electrophotography, electrostatic recording, and the like.

BACKGROUND OF THE INVENTION

Recording systems for visualizing image information through an electrostatic latent image, such as electrophotography, are now widespread in various fields. In electrophotography, an electrophotographic photoreceptor is charged and then exposed to light to form an electrostatic latent image, the latent image is developed with a developer containing a toner, and the toner image is transferred and fixed. The developer used herein includes a two-component developer comprising a toner and a carrier and a one-component developer comprising a toner, e.g., a magnetic toner, alone.

In the two-component developer, since a carrier bears such functions as agitation, delivery and charging of the developer, the two-component developer is characterized by satisfactory controllability and largely employed for the present time. In particular, developers using a resin-coated carrier are excellent in charge controllability and are relatively easy to improve environmental dependence and stability with time.

Development was formerly carried out by cascade development, but nowadays magnetic brush development using a magnetic roll as a developer carrier is dominant.

Magnetic brush development using a two-component developer has such disadvantages as reduction of image density and considerable background stain both due to reduction in charging properties of the developer, image roughness and consumption loss of the carrier both due to adhesion of the carrier onto the image, and occurrence of unevenness of image density. It is considered that with a reduction in resistance of the carrier, the induced charges are injected into the image area, resulting in adhesion of the carrier to the image area; or it is considered that charge quantity of the carrier after development becomes excessive on account of insufficient control of the upper limit of charge quantity of the carrier, resulting in adhesion of the carrier to the edges of the image area.

In recent years, negatively chargeable organic photoreceptors have been spread, and reversal development in which an electrostatic latent image is formed by using a laser, etc. has been frequently applied to inorganic photoreceptors. Accordingly, there have been increasing demands for high quality developers using a positively chargeable toner as well as a negatively chargeable toner. To this effect, it is desirable that the carrier to be used has freely controllable charging properties in accordance with the polarity and intensity of charge of the toner.

Fluorine-containing resin-coated carriers have been proposed as carriers for positively chargeable toners. However, fluorine-containing resins such as polyvinylidene fluoride have poor adhesion to core particles and often fail to retain charging properties in long-term use. Further, the resin coat is apt to fall off to reduce electrical resistance of the carrier, causing adhesion of the carrier to image areas, black spots due to the released coating material, and unevenness of image density. It has been proposed to use an adhesion-imparting resin in combination for improving adhesion of negatively chargeable resins onto core particles as disclosed in JP-A-54-110839 (the term "JP-A" as used herein means an "unexamined published Japanese patent application"), but sufficient effects cannot always be obtained.

High temperature treatment at 200° C. or higher has been adopted for improving adhesion of a coating material to core particles. However, exposure of a resin containing fluorine in high concentrations to such high temperatures is unavoidably accompanied with evolution of harmful gases such as hydrogen fluoride, which possibly causes reduction in durability of equipment, deterioration of safety and hygiene, and environmental disruption. Although it is not impossible to lower the melting point of a fluorine-containing resin by, for example, copolymerization, a drop in melting point of a coating material tends to lessen the strength of the coat and to cause reduction in retention of charging properties.

It is also known to use a solution of a fluorine-containing resin to improve adhesion to core particles (solution coating method). However, the solvents used, e.g., dimethylformamide, have a high boiling point and high toxicity. Use of solvents of relatively low toxicity, such as methyl ethyl ketone and methyl isobutyl ketone, has been proposed, but fluorine-containing resins have insufficient solubility in these solvents so that coating must be conducted over a long period of time using a large quantity of the solvent.

Further, in conventionally employed solution coating methods using a fluidized bed apparatus or a spray drier, the coated carrier particles easily agglomerate with each other irrespective of the kind of the coating resin. It is therefore necessary to conduct deagglomeration treatment or to limit the amount of the resin to be coated, thus leaving problems of production process and product quality.

Since fluorine-containing resins generally have poor solubility in organic solvents, various solventless coating methods have been proposed. For example, it has been proposed to heat a powder mixture of core particles and a coating resin above a melting point of the coating resin in a still state to form a coating layer as disclosed in JP-A-54-35735. In this method, since formation of the coating layer is largely dependent on melt rheological behavior of the coating resin, it is very difficult to use a resin having a high viscosity in a molten state. Further, being coated in a still state, the carrier particles unavoidably agglomerate and require a post-treatment, such as deagglomeration treatment, thus attaining a poor production efficiency. Moreover, it is difficult to form a continuous coating layer having a smooth surface.

It has also been proposed to dry blend core particles and coating resin particles and heat-melt the blend in a fluidized bath or a rotary furnace, followed by cooling as disclosed in JP-A-55-118047, JP-A-60-170865 and JP-A-62-106475. However, since mixing o the core particles and coating resin particles depends on gravity shearing, the shearing force acting on particles is insufficient for thorough mixing, failing to form a uniform coating layer on the carrier particles. Particularly in cases where the core particles have a small size or a small specific gravity, or where the core particles are irregular in shape, or where the amount of the coating resin is large, the same problems as encountered in the above-described coating method of JP-A-54-35735 are involved.

Further, a coating method in which an impact force is repeatedly given to a mixture of core particles and coating resin particles to spread the coating resin to thereby form a coating layer has been proposed as disclosed in JP-A-63-235963, JP-A-63-235964, and JP-A-63-298254. However, the core particles are liable to be broken by the impact force. In addition, a controllable range of the coat thickness is narrowly restricted, and the coat thickness is less controllable than the solution coating method. As a result, this method is poor in controllability of resistance and charging properties.

In order to improve adhesion of negatively chargeable resins to core particles, it has been proposed to provide an intermediate layer therebetween as disclosed in JP-A-49-51950 or to blend a fluorine-containing resin with a second resin having strong adhesiveness to core particles as disclosed in JP-A-54-110839 and JP-A-56-113146. However, since the resins proposed exhibit opposite polarity to fluorine-containing resins, a blending ratio satisfying adhesion requirements consistently with charging properties is so limited. Although methyl methacrylate copolymers, etc. as proposed are excellent in compatibility with fluorine-containing resins and effective to improve adhesion, they adversely affect the excellent properties inherent in fluorine-containing resins such as solid lubricating properties and low tackiness, resulting in interference with improvement of surface stain resistance of the carrier.

SUMMARY OF THE INVENTION

Accordingly, an object of the present invention is to provide a carrier for developing an electrostatic latent image which is excellent in stability with a lapse of time and environmental changes, which is prevented from adhering to image areas and thereby from being largely consumed, and which provides satisfactory image quality.

Another object of the present invention is to provide a fluorine-containing resin-coated carrier having improved retention of charging properties and improved strength of the coating layer thereof and suitable for use in high quality two-component developers for organic photoreceptors and for reversal development of inorganic photoreceptors.

A further object of the present invention is to provide a process for producing the above-described carrier with ease and safety and at low cost without using any organic solvent.

A still further object of the present invention is to provide a process for producing the above-described carrier, in which the amount of a coating resin can be selected with relative freedom without restrictions of the molecular weight or solvent solubility of the coating resin thereby making it possible to arbitrarily control characteristics of the resulting carrier such as charging properties and electrical resistance.

Other objects and effects of the present invention will be apparent from the following description.

The present invention provides a carrier for developing an electrostatic latent image, which carrier comprises core particles having formed thereon a resin coating layer, in which the resin coating layer comprises a fluorine-containing resin and a second resin having a softening point lower than that of the fluorine-containing resin, and the fluorine-containing resin and the second resin each are partially exposed on the surface of the resin coating layer.

The present invention also provides a process for producing a carrier for developing an electrostatic latent image comprising the steps of: dry-blending core particles, a fluorine-containing resin, and a second resin having a softening point lower than that of the fluorine-containing resin; and melting the resin blend to coat the core particles.

DETAILED DESCRIPTION OF THE INVENTION

A blending ratio of a fluorine-containing resin and a second resin is generally arbitrarily selected from the range of 95/5 to 5/95 by weight. Since the fluorine-containing resin has very high negative charging properties, the fluorine-containing resin can be blended with the second resin at any selected blending ratio to provide a carrier having either positive charging properties or negative charging properties. Specifically, use of the fluorine-containing resin in a proportion of about 50% by weight or more generally affords a negatively charging carrier while use of the second resin in a proportion of about 50% by weight or more generally affords a positively charging carrier. In the negatively charging carrier, the ratio of the fluorine-containing resin and the second resin is preferably from 80/20 to 50/50 by weight. In the positively charging carrier, the ratio is preferably from 50/50 to 20/80 by weight.

The fluorine-containing resin and second resin are "partially exposed" on the surface of a coating layer. This means that the two resins are dispersed on the surface of the coating layer to form a so-called sea-island structure. Such a sea-island structure can be confirmed as a difference in contrast under observation with a scanning electron microscope (SEM) under an accelerating voltage condition of a low electrical field. The structure may also be confirmed by differential thermal analysis with a differential scanning calorimeter (DSC), in which an endothermic peak assigned to a fluorine-containing resin and another endothermic peak assigned to a second resin are separately observed. Where a single endothermic peak is observed, both resins are judged to be mixed in substantial uniformity to form a resin layer. In other words, the sea-island dispersed state indicates that a plurality of coating resins are in an incompatible state, or an isolated state, and one of the two resins that forms a major proportion becomes a sea region, with the other becoming islands dispersed therein. Discrimination between sea and island regions can be detected by the above-mentioned SEM observation or by Auger electron spectroscopy (AES) in which the isolated state of the composition is analyzed from whether an element, e.g., fluorine, is detected or not.

The fluorine-containing resin which can be used in the present invention preferably includes those having a softening point of not more than 150° C., and more preferably between 80° and 150° C. If a fluorine-containing resin having a softening point exceeding 150° C. is used, the temperature of the equipment for the production of the carrier must be raised above 200° C., resulting sometimes in the failure of normal coating. If the softening point of the fluorine-containing resin is less than 80° C., the carrier particles are liable to agglomerate during production, resulting in a reduction in yield of the carrier of desired particle size.

The second resin which can be used in combination with the fluorine-containing resin preferably has a softening point lower than the fluorine-containing resin by at least 30° C. However, since a second resin having too a low softening point tends to deteriorate fluidity of the carrier, causing toner contamination, the lower limit of the softening point of the second resin is preferably about 40° C.

The dry blend of the above two resins with core particles is preferably melted by heating at a temperature above the melting points of the both resins.

The present invention succeeds in greatly improving charging controllability, charging properties retention, and strength of the coating layer by using a combination of a fluorine-containing resin and a second resin having different softening points. While the reason for the success is not necessarily clear, the difference in softening point seems to bring about a difference in compatibility.

Examples of the fluorine-containing resins which can be used in the present invention include copolymers of fluorine-containing vinyl monomers, e.g., vinylidene fluoride, tetrafluoroethylene, hexafluoropropylene, monochlorotrifluoroethylene, monofluoroethylene, and trifluoroethylene.

The fluorine-containing resin preferably flows by melting at a temperature of from 50° to 200° C. If its melt-flow temperature is higher than 200° C., the productivity tends to be deteriorated. Polymers containing repeating units derived from vinylidene fluoride are preferably used, and preferred examples thereof include vinylidene fluoride homopolymers, vinylidene fluoride-tetrafluoroethylene copolymers and vinylidene fluoride-hexafluoropropylene copolymers. Monochlorotrifluoroethylene-vinyl chloride copolymers are also preferably used.

Examples of the second resins which can be used in the present invention include homopolymers and copolymers of styrene or derivatives thereof, e.g., chlorostyrene and methylstyrene; α-methylene aliphatic monocarboxylic acids or esters thereof, e.g., methyl methacrylate, methyl acrylate, propyl acrylate, lauryl acrylate, methacrylic acid, acrylic acid, butyl methacrylate, butyl acrylate, 2-ethylhexyl acrylate, and ethyl methacrylate; nitriles, e.g., acrylonitrile and methacrylonitrile; vinylpyridines, e.g., 2-vinylpyridine and 4-vinylpyridine; vinyl ethers; vinyl ketones; olefins, e.g., ethylene, propylene and butadiene; and organosiloxanes, e.g., methylsilicone, methylphenylsilicone; as well as polyesters containing bisphenol, glycol, etc.

Of these second resins, silicone resins are preferred, with methylphenylsilicone polymers being more preferred. In particular, methylphenylsilicone polymers having a softening point of 50° C. or higher are particularly preferred.

Generally containing a hydroxyl group more or less, silicone polymers are ready to crosslink through dehydration on heating or through alcohol removal on solvent removing. As a result, besides showing no clear softening point, they generally have a high viscosity on heating and are therefore unsuitable for the production of carriers involving a heating step. For instance, three-dimensional crosslinked silicone fine particles, e.g., "Torefin" produced by Toray Industries, Inc., scarcely show heat curing behavior and cannot be made use of in film formation.

As a result of examination on heat curing behaviors of various silicone polymers, the present inventors ascertained that methylphenylsilicone polymers are suitable as coating resins. Methylphenylsilicone polymers include, for example, polymers comprising a monomer unit represented by formula (1), (2) or (3):

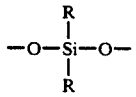
(1)

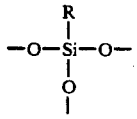
(2)

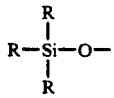
(3)

wherein R represents a methyl group or a phenyl group.

Polymers comprising the above-described monomer units have a relatively linear structure carrying substantially no hydroxyl group, have a distinct softening point, and show fluidity on heating, and are therefore capable of film formation. That is, a coating resin containing the above-mentioned methylphenylsilicone polymer can be applied to a coating process consisting of dry-blending with core particles, heating and melting the blend, and cooling to obtain uniformly coated carrier.

The methylphenylsilicone polymer may also be used individually. In this case, it exhibits characteristics as a positively charging carrier and, when combined with a negatively chargeable toner, assures satisfactory charging characteristics. It can also be used in combination with a negatively chargeable resin such as the above-described fluorine-containing resin, to assure a proper quantity of negative charge. The methylphenylsilicone polymer is thus applicable to either positively or negatively chargeable toners. The charge quantity can be controlled by using a combination of the methylphenylsilicone polymer and a fluorine-containing resin in an appropriate ratio or by adjusting the total resin coverage. A proper range of charge quantity is subject to variation depending on the toner particle size. For example, with a toner having an average particle size of 10 μm, a blow-off charge quantity ranges from 5 to 40 μc/g, and preferably from 10 to 30 μc/g.

Examples of the resin that can be used in combination with the methylphenylsilicone polymer include polystyrene, styrene-(meth)acrylate copolymers and (meth)acrylate polymers, as well as the above-described fluorine-containing resins. The term "(meth)acrylate" herein means acrylate and/or methacrylate.

The ratio of the resin used in combination with the methylphenylsilicone polymer is generally from 0.1 to 10% by weight, preferably from 0.2 to 5% by weight, based on the amount of the methylphenylsilicone polymer.

Further, the above polymer shows low surface energy behavior and thereby protects the carrier from contamination to retain satisfactory charging performance.

If desired, high strength resins, e.g., acrylic resins, may be used in addition so as to reinforce the coating layer.

In order to avoid agglomeration of carrier particles during a cooling step and to prevent reduction of fluidity of the developer with a temperature rise in a developing machine upon use, the methylphenylsilicone polymer preferably have a softening point of not less than 50° C. The upper limit of the softening point is not particularly critical but is usually 200° C. and preferably 150° C., with durability of equipment, cooling efficiency per unit time, and safety being taken into consideration.

The fluorine-containing resin and second resin are used in a total amount of from about 0.2 to 10% by weight, and preferably from 0.5 to 3% by weight, based on the amount of the carrier.

Core particles which can be used in the present invention include ferromagnetic metals or alloys, e.g., iron, cobalt, nickel, ferrite, and magnetite; compounds containing such elements; alloys which contain no ferromagnetic element but are rendered ferromagnetic by heat treatment, e.g., Heusler's alloys containing manganese or tin (e.g., Mn-Cu-Al, Mn-Co-Sn); and chromium dioxide. The core particles have a particle size usually of from about 20 to about 200 μm, and preferably from about 40 to about 150 μm.

The carrier of the present invention can be produced by the use of any mixing machine equipped with a heating means using a heating medium, e.g., a kneader, a Henschel mixer, an attritor, a Lodige mixer (Lodige Corp.), a UM mixer, a planetary mixer, etc. Heating type fluidized rolling bed or heating type kiln in which blade shearing is hard to apply may also be employed depending on the compounding ratio of resins, etc.

The carrier of the present invention is preferably produced by a process comprising the steps of: dry-blending core particles, a fluorine-containing resin, and a second resin having a softening point lower than the fluorine-containing resin, and heat melting the resin blend to coat the core particles. The heating for melting is preferably conducted at a temperature higher than the melting points of the both resins.

In one preferred embodiment of the process according to the present invention, magnetic core particles and coating resin particles, etc. are dry-blended by means of a shear mixing machine in which the clearance D between the stirring blade tip and the inner wall of the mixing tank and the radius R of the stirring blade satisfies the relationship $0.002 \leqq D/R \leqq 0.2$ and the blade tip velocity V is set at 0.2 to 5 m/sec, and the mixture is heated to the softening point of the coating resin or higher with stirring, followed by cooling to a temperature below the softening point with stirring.

According to the above-described preferred embodiment, the stirring blade forcedly stirs the mixture to impose a forced shearing force whereby the magnetic core particles and coating resin are always kept completely mixed. Further, the mixture is heated to the softening point of the coating resin or higher temperatures while stirring so that the resin can be melt softened and spread to form a continuous coating layer having a smooth surface. Furthermore, the subsequent cooling while stirring prevents the carrier particles from agglomeration with each other.

The above-described preferred embodiment is characterized in that the velocity V of the stirring blade tip is selected from the range of from 0.2 to 5 m/sec. The terminology "velocity V" of the stirring blade tip as used herein is expressed in terms of a relative speed of the blade tip with respect to the inner wall of the mixing machine when the tip is closest to the inner wall. In the case of using a planetary stirring mixing machine whose blade rotates both on its own axis and on the axis of the mixing machine, e.g., "Vortex Mixer" manufactured by Kitagawa Tekkosho K.K. and a twin-screw planetary mixer manufactured by Tokushukika Kogyo K.K., the velocity V of the stirring blade tip is expressed in terms of the sum of the speed of rotation on its own axis and that on the axis of the mixing machine. In the case of using a mixing machine in which the stirring blade and the mixing tank rotate to opposite directions, e.g., "Pony Mixer" manufactured by Hosokawa Tekkosho K.K., the velocity V of the stirring blade tip is expressed in terms of the sum of the speed of rotation of the blade tip and that of the mixing tank.

If the velocity V is less than 0.2 m/sec, mixing of the magnetic core particles and coating resin tends to become non-uniform to cause a localized temperature distribution on heating, making it difficult to form a desired coating film in a stable manner. Further, the heat transfer efficiency on heating may be low so that a long period of time is required for coating film formation. Furthermore, the forced shearing force becomes so weak that the desired effects of preventing agglomeration of carrier particles and forming a smooth coating layer tend to be failed.

If the velocity V is higher than 5 m/sec, an excessive shearing force is exerted among carrier particles, resulting in formation of a coating film having a rough surface. Further, an excessive load is imposed on the stirring blade to adversely affect durability of equipment.

The above-described preferred embodiment is also characterized in that the clearance D between the stirring blade tip and the inner wall of the mixing tank and the radius R of the blade satisfy the relationship: $0.002 \leqq D/R \leqq 0.2$. The terminology "clearance D" as used herein is the smallest one with the blade tip being closest to the inner wall. If the D/R value is less than 0.002, an excessive load is imposed on the stirring blade according as the mixture increases its viscosity, thus impairing durability of equipment. If it exceeds 0.2, there are left dead spaces where the mixture remains insufficiently stirred, causing some scatter in the state of coating or a reduction in yield.

An illustrative example of the procedure for coating film formation on core particles is given below, but the present invention is not construed as being limited thereto.

In a first step, magnetic core particles and coating resin particles are uniformly dry-mixed to maintain an ordered mixture state. The mixing may be carried out by premixing by use of a mixing machine with no stirring blade, such as a twin-cylinder mixer, followed by mixing by use of the stirring machine as above specified. The mixing may be effected while preheating the mixture at temperatures lower than the softening point of the coating resin. The terminology "ordered mixture state" as used above is not to imply that the core particles and coating resin should have adhesion to each other as required in systems in which a coating resin is adhered to or buried in core particles by electrostatic attraction or mechanical force such as conventional dry coating methods. Such an adhesive force is unnecessary in the preferred embodiment of the present invention because in the subsequent step for coating film formation hereinafter described, a complete mixing state can be maintained even with very little adhesion between the magnetic core particles and coating resin particles as long as the stirring under the conditions according to the preferred embodiment of the present invention is carried on.

In a second step, the mixture is heated to the softening point of the coating resin or higher temperatures while being stirred under the stirring conditions specified above. By this heating with stirring, the coating resin is softened, and a compressive force and a shearing force are exerted among the core particles and coating resin particles, whereby the coating resin particles are spread to form a smooth and continuous film on the surface of the core particles.

In a third step, the system is cooled while being forcedly stirred whereby coated carrier particles can be recovered while retaining the high quality of the coating film obtained in the second step and preventing the particles from agglomeration.

Among the stirring conditions according to the preferred embodiment of the present invention, the velocity of the stirring blade tip can be subject to variation according to the viscosity of the mixture. For the sake of convenience in carrying out each step or in operating the equipment, the velocity of the stirring blade tip may temporarily deviate from the above-specified range. Such cases are also included in the scope of the present invention as long as the velocity falls within the above-described specific range in the carrier coating film formation process.

Mixing machines to be used in the present invention are not particularly limited, and it is preferred that the mixing tank is equipped with a stirring blade(s) and a heating means. The stirring blade may be any of those having a stirring function capable of exerting a forced stirring force or a forced shearing force onto the mixture. Examples of the stirring blades include a revolving blade for forcedly making a mixture to flow, a revolving chopper giving a forced shearing force for prevention of agglomeration of core particles, and a scraper for scraping off a mixture sticking to the inner wall of the mixing tank.

Further, the mixing machines to be used should have a heating means with which coating resin particles are heated to their softening point or higher and thereby fused onto the surface of core particles. Examples of mixing machines having such a heating means include, while not limiting, a heat transfer system using a jacketed mixing tank with warm water, steam or other heat transfer media being circulated in the jacket and a direct heating system consisting of blowing hot air directly into a mixing tank.

Cooling of the mixture can be carried out by, for example, exchanging a heat transfer medium with a cooling medium, blowing cool air into a mixing tank, or simply allowing the mixture to cool.

Specific but non-limiting examples of the mixing machines used in the preferred embodiment of the present invention include wheel type mixing machines, e.g., "Mixmaler" manufactured by Shinto Kogyo K.K., "Stotz Mill" manufactured by Stotz, "Eirich Mill" manufactured by Einch; blade type mixing machines, e.g., "Batch Kneader" manufactured by Satake Kagaku Kikai K.K., "Pony Mixer" manufactured by Hosokawa Micron K.K., "MZ Processor" manufactured by Ohkawara Seisakusho K.K., "Vortex Mixer" manufactured by Kitagawa Tekkosho K.K., "Planetary Mixer" manufactured by Tokushukika Kogyo K.K., "Ribbon Blender" manufactured by Tokuju Kosakusho K.K., and "Drum Mixer" manufactured by Sugiyama Jukogyo K.K.; and shovel type mixing machines, e.g., "Lodige Mixer" manufactured by Lodige.

The coating resin particles generally have a particle size of not greater than $\frac{1}{3}$, and preferably not greater than 1/5, of the particle size of core particles. If they are greater than $\frac{1}{3}$, it takes much time for the resin particles to be melted and spread to form a continuous film.

If desired, inorganic fine particles, carbon black or infusible silicone fine particles may be compounded into the coating resin for adjustment of conductivity of the coating layer and for improvement of fluidity of the carrier. Where such fine particles are used in conventional solution coating methods, it is necessary to previously disperse the fine particles in a resin solution by means of a ball mill, etc. whereas in the present invention addition of these fine particles in a mixing step together with coating resin particles and core particles causes no production problem because the fine particles added can be dispersed in the coating resin by the forced stirring in the subsequent step of film formation in a molten state. Where the above-described fine particles are added, they are used in an amount generally of from 0.5 to 80% by weight, and preferably from 2 to 50% by weight, based on the coating resin.

The coating resin is generally used in an amount of from 0.2 to 10% by weight, and preferably from 0.5 to 3% by weight, based on the weight of the carrier.

The carrier according to the present invention is mixed with a toner to provide a two-component developer. Toners generally comprise binder resins having dispersed therein colorants, etc. Examples of the binder resins include homopolymers or copolymers of styrene or derivatives thereof, e.g., p-chlorostyrene and α-methylstyrene; α-methylene aliphatic monocarboxylic acid esters, e.g., methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles, e.g., acrylonitrile and methacrylonitrile; vinylpyridines, e.g., 2-vinylpyridine and 4-vinylpyridine; vinyl ethers, e.g., vinyl methyl ether and vinyl isobutyl ether; vinyl ketones, e.g., vinyl methyl ketone, vinyl ethyl ketone, and vinyl isopropenyl ketone; unsaturated hydrocarbons or halides thereof, e.g., ethylene, propylene, isoprene, and butadiene; and halogenated unsaturated hydrocarbons, e.g., chloroprene; mixtures of these homo- or copolymers; and, in addition, non-vinyl condensed resins, e.g., rosin-modified phenol-formalin resins, epoxy resins, polyester resins, polyurethane resins, polyamide resins, cellulose resins, and polyether resins, or mixtures of these non-vinyl condensed resins and the above-enumerated vinyl resins.

Examples of useful colorants include carbon black, nigrosine dyes, Aniline Blue, chrome yellow, Ultramarine Blue, Methylene Blue, Rose Bengale, Phthalocyanine Blue, and mixtures thereof.

Other toner components than colorants include charge control agents, offset inhibitors, and fluidity improving agents. If desired, the toner may further contain magnetic fine powders.

The present invention is now illustrated in greater detail with reference to Examples and Comparative Examples, but it should be understood that the present invention is not deemed to be limited thereto. All the parts, percents, and ratios are given by weight unless otherwise indicated.

EXAMPLES 1 TO 3 AND COMPARATIVE EXAMPLES 1 TO 4

Cu-Zn ferrite core particles having an average particle size of 80 μm were compounded with a fluorine-containing resin and a second resin as shown in Table 1 below. The blend was mixed in a 5L small-sized kneaded for 5 minutes and then kneaded with stirring for 40 minutes at a heat transfer medium temperature of 195° C. The heater was switched off, and the mixture was cooled with stirring for 50 minutes. The mixture was then sifted through a sieve having an opening of 177 μm to obtain a carrier.

The surface of the carrier was observed under an SEM to examine the carrier coat state. The results of observation are shown in Table 1.

Separately, a mixture of 84% of a styrene-n-butyl methacrylate copolymer as a binder resin, 10% of carbon black "Cabot BPL", 2% of a charge control agent "Bontron N04" (produced by Orient Kagaku K.K.), and 4% of a polyethylene wax "400P" (produced by Mitsui Petrochemical Industries, Ltd.) was milled to prepare a toner having an average particle size of 11 μm.

The carrier and toner were mixed to prepare a two-component developer having a toner concentration of 4%.

Each of the resulting developers was tested for image quality retention by using a copying machine "FX 5017 Modified Model" manufactured by Fuji Xerox Co., Ltd. The results obtained are shown in Table 1.

TABLE 1

| Example No. | Fluorine-containing resin: Kind (Softening point) | Fluorine-containing resin: Amount (wt %) | Second resin: Kind (Softening point) | Second resin: Amount (wt %) | Image quality: Initial | Image quality: After obtaining 50,000 copies | Remark | Coat surface (SEM) |
|---|---|---|---|---|---|---|---|---|
| Compar. Ex. 1 | VDF-4FE 80/20 (125° C.) | 1.0 | St-MMA (100° C.) | 0.3 | low density, carrier adhesion | background stain | | uniform over almost the entire surface |
| Ex. 1 | VDF-4FE 80/20 (125° C.) | 1.0 | St-MMA-nBMA (90° C.) | 0.3 | no problem | no problem | satisfactory image quality retention | sea-island structure |
| Compar. Ex. 2 | VDF-6FP 86/14 (147° C.) | 0.7 | PMMA (135° C.) | 0.3 | low density, carrier adhesion | unevenness of density | large consumption of carrier | uniform coat |
| Ex. 2 | VDF-6FP 86/14 (147° C.) | 0.7 | St-MMA (100° C.) | 0.3 | no problem | no problem | satisfactory image quality retention | sea-island structure |
| Compar. Ex. 3 | VDF-6FP 80/20 (138° C.) | 1.0 | PMMA (135° C.) | 0.3 | low density, carrier adhesion | background stain, unevenness of density | large consumption of carrier | uniform coat |
| Ex. 3 | VDF-6FP 80/20 (138° C.) | 1.0 | St-MMA (90° C.) | 0.3 | no problem | no problem | satisfactory image quality retention | sea-island structure |
| Compar. Ex. 4 | PVDF 100 (174° C.) | 0.5 | PMMA (135° C.) | 0.5 | somewhat low density | carrier adhesion | black spots due to fall off of coat | uniform over almost the entire surface |

Note:
VDF: Vinylidene fluoride
4FE: Tetrafluoroethylene
6FP: Hexafluoropropylene
PMMA: Polymethyl methacrylate
MMA: Methyl methacrylate
St: Styrene
nBMA: n-Butyl methacrylate
PVDF: Polyvinylidene fluoride As can be seen from Table 1, the developers according to the present invention caused no image defect even after obtaining 50,000 copies, exhibiting satisfactory image quality retention. To the contrary, the comparative developers, which had a uniform coat surface, caused reduction in density and adhesion of the carrier in the initial stage of copying, and the images after obtaining 50,000 copies underwent unevenness in density and background stain. Moreover, the comparative carriers were largely consumed.

EXAMPLE 4

A methylphenylsilicone polymer "M9080" (produced by Toray Dow Corning Silicone) having a softening point of 70° C. (DSC peak value) was ground in a jet mill grinder to an average particle size of 15 μm. Ten parts of the resulting polymer particles was added to 1,000 parts of Cu-Zn ferrite core particles having an average particle size of 80 μm (product of Powder Tech), and mixed in a 5L small-sized kneader for 5 minutes and then kneaded with stirring for 40 minutes at a heat transfer medium temperature of 195° C. The heater was switched off, and the mixture was cooled with stirring for 50 minutes, followed by sifting using a sieve of 177 μm to obtain a carrier.

The surface of the carrier was observed by SEM, and it was found that the coating layer had a smooth surface.

Separately, a mixture consisting of 85% of a styrene-n-butyl methacrylate copolymer as a binder resin, 10% of carbon black "Cabot BPL", 1% of a charge control agent "TRH" (produced by Hodogaya Chemical Co., Ltd.), and 4% of a polyethylene wax "400P" (produced by Mitsui Petrochemical Co., Ltd.) was milled to obtain a toner having an average particle size of 10 μm.

The toner and carrier were mixed to prepare a two-component developer having a toner concentration of 4%. The resulting developer had a charge quantity of -22 μc/g as measured with a blow-off charge meter manufactured by Toshiba Corp.

The developer was tested for image quality retention by using a copying machine "FX5039" manufactured by Fuji Xerox Co., Ltd. The resulting copies even after 50,000 runs were excellent in image quality, i.e., clear and free from background stain or density unevenness. Further, the consumption of the carrier was small.

EXAMPLE 5

A methylphenylsilicone polymer "M9110" (produced by Toray Dow Corning Silicone) having a softening point of 100° C. (DSC peak value) was ground in a jet mill grinder to an average particle size of 15 μm. Thousand parts of Cu-Zn ferrite core particles having an average particle size of 60 μm (produced by TDK) were mixed with 5 parts of the resulting polymer particles and 10 parts of a vinylidene fluoride-tetrafluoroethylene copolymer "KYNAR 7201" (produced by Penwalt), and the mixture was mixed in a 15L planetary mixer for 10 minutes and then kneaded with stirring for 30 minutes at a heat transfer medium temperature of 220° C. The heater was switched off, and the mixture was cooled with stirring for 40 minutes, followed by sifting using a sieve of 149 μm to obtain a carrier.

The surface of the carrier was observed by SEM, and it was found that the two polymers formed sea-island structure on the surface of the coating layer.

The resulting carrier was mixed with the same toner as used in Example 1 to prepare a two-component developer having a toner concentration of 4%. The resulting developer had a charge quantity of +20 μc/g as measured with a blow-off charge meter manufactured by Toshiba Corp.

The developer was tested for image quality retention by using a copying machine "FX 5017 Modified Model". The resulting copies even after 50,000 runs were clear and free from background stain or density unevenness. Further, the consumption of the carrier was small.

EXAMPLE 6

A methylphenylsilicone polymer having a softening point of 70° C. (DSC peak value) "M9080" was ground in a jet mill grinder to an average particle size of 15 μm. Thousand parts of iron powder having an average particle size of 100 μm "TSRYV" (produced by Powder Tech) was added to 8 parts of the resulting polymer particles and 4 parts of a styrene-methyl methacrylate copolymer "BR 52" (produced by Mitsubishi Rayon Co., Ltd.), and mixed in a 5L small-sized kneader for 5 minutes and then kneaded with stirring for 40 minutes at a heat transfer medium temperature of 195° C. The heater was switched off, and the mixture was cooled with stirring for 50 minutes followed by sifting using a sieve of 250 μm to obtain a carrier.

The surface of the carrier was observed by SEM, and it was found that the coated layer had a smooth surface.

The carrier was mixed with the same toner as used in Example 4 to prepare a two-component developer having a toner concentration of 4%. The resulting developer had a charge quantity of −18 μc/g as measured with a blow-off charge meter manufactured by Toshiba Corp.

The developer was tested for image quality retention by using a copying machine "FX 6790 Modified Model" manufactured by Fuji Xerox Co., Ltd. As a result, copies even after 200,000 runs were clear and free from background stain or density unevenness. Further, the consumption of the carrier was small.

EXAMPLE 7

A carrier was produced under the following conditions by using a batchwise kneader comprising a 50 l-volume mixing tank having a jacket for circulation of a heat transfer medium and even speed overlap type sigma-blades having a radius R of 15 cm with a clearance D between the blade and the inner wall of the mixing tank being set at 5 mm (D/R value: 0.033).

Thirty kilograms of Cu-Zn ferrite spherical core particles having an average particle size of 80 μm, 400 g of polyvinylidene fluoride having a softening point of 160° C. (DSC peak value) and an average particle size of 0.3 μm ("KYNAR201" produced by Penwalt), and 150 g of a styrene-methyl methacrylate copolymer having a softening point of 120° C. (DSC peak value) and an average particle size of 5 μm ("BR-52" produced by Mitsubishi Rayon Co., Ltd.) were dry blended i the above-described kneader at room temperature for 10 minutes with the velocity of the blade tip set at 0.3 m/sec. The temperature of the mixture was 23° C. Then, the mixture was further stirred for 40 minutes while circulating a heat medium set at 220° C. in the jacket. On completion of the heating, the temperature of the mixture reached 170° C. The heat medium in the jacket was exchanged with a cooling medium set at 30° C., and the stirring was further continued for 30 minutes. The thus cooled mixture had a temperature of 83° C. The mixture was sifted through a sieve of 149 μm to obtain a carrier.

The surface of the carrier was observed by SEM, and it was found that the two polymers formed sea-island structure on the surface of the coating layer.

While the invention has been described in detail and with reference to specific examples thereof, it will be apparent to one skilled in the art that various changes and modifications can be made therein without departing from the spirit and scope thereof.

What is claimed is:

1. A carrier for developing an electrostatic latent image comprising core particles having formed thereon a resin coating layer, said resin coating layer comprising a fluorine-containing resin and a second resin having a softening point lower than that of said fluorine-containing resin by an amount sufficient to cause said fluorine-containing resin and said second resin each to be partially exposed on the surface of said resin coating layer so as to form a sea-island structure thereon.

2. A carrier as claimed in claim 1, wherein said fluorine-containing resin has a softening point of not more than 150° C., and said second resin has a softening point lower than that of the fluorine-containing resin by at least 30° C.

3. A carrier as claimed in claim 2, wherein said fluorine-containing resin has a softening point of from 80° to 150° C., and said second resin has a softening point of 40° C. or higher.

4. A carrier as claimed in claim 1, wherein said second resin is a silicone resin.

5. A carrier as claimed in claim 4, wherein said silicone resin is a methylphenylsilicone polymer having a softening point of 50° C. or higher.

6. A carrier for developing an electrostatic latent image, said carrier providing excellent image quality and comprising core particles having formed thereon a resin coating layer, said resin coating layer comprising a methylphenylsilicone polymer having a softening point of 50° C. or higher, said resin coating layer excluding fluorine-containing resins.

* * * * *